United States Patent [19]

Kurosawa et al.

[11] Patent Number: 4,748,837

[45] Date of Patent: Jun. 7, 1988

[54] METHOD OF FORMING SPHERICAL SHELLS

[75] Inventors: Hiroshi Kurosawa; Izumi Ochiai; Yoshio Asahino, all of Tochigi, Japan

[73] Assignee: Hitachi, Ltd., Tokyo, Japan

[21] Appl. No.: 940,493

[22] Filed: Dec. 10, 1986

[30] Foreign Application Priority Data

Dec. 11, 1985 [JP] Japan ..... 60-276704
Mar. 14, 1986 [JP] Japan ..... 61-54794

[51] Int. Cl.[4] ..... B21D 22/10

[52] U.S. Cl. ..... 72/63; 72/57; 29/421 R; 425/389; 425/DIG. 19

[58] Field of Search ..... 72/54, 56, 63, 57; 29/421 R; 425/DIG. 19, 389

[56] References Cited

U.S. PATENT DOCUMENTS

| | | | |
|---|---|---|---|
| 1,329,969 | 2/1920 | Harrison | 72/63 |
| 2,344,743 | 3/1944 | Smith, Jr. | 72/63 |
| 3,208,104 | 9/1965 | Hessel | 425/389 |
| 3,463,035 | 8/1969 | Bright | 72/54 |
| 3,546,740 | 12/1970 | Johnson | 425/389 |
| 3,646,653 | 3/1972 | Richard | 72/54 |
| 3,670,546 | 6/1972 | De La Sierra | 72/63 |

FOREIGN PATENT DOCUMENTS

| | | |
|---|---|---|
| 218005 | 8/1984 | Japan . |
| 218004 | 8/1984 | Japan . |

*Primary Examiner*—David Jones
*Attorney, Agent, or Firm*—Antonelli, Terry & Wands

[57] ABSTRACT

A process for manufacturing a spherical shell from a blank utilizing dies, comprising the steps of forming and clamping a flange portion of the blank by pressing with the dies and applying fluid pressure to an elastic diaphragm or flat metal sheet to cause the diaphragm or sheet to bulge the blank so as to form a curved shell surface.

2 Claims, 4 Drawing Sheets

METHOD OF FORMING SPHERICAL SHELLS

BACKGROUND OF THE INVENTION

This invention relates to a method of forming a spherical shell, and more particularly to a method of forming a metal blank (blanked sheet) in the form of a spherical shell suitable for manufacturing articles having an accurate surface with a gentle curvature such as parabolic antennas, roof panels of vehicles or convex mirrors.

Traditionally, parabolic antennas and roof panels of vehicles, etc., have been manufactured in a manner wherein a metal plate is pressed between male and female dies or convex and concave dies.

However, when a curved surface having a gentle curvature is formed, there is much spring back and, moreover, the distribution of the degree of spring back is irregular due to variations in the thickness of the plate which is to be pressed. It is thus difficult to obtain worked articles having a sufficient degree of accuracy.

In the case of a manufacturing apparatus for manufacturing parabolic antennas of the type which was disclosed in Japanese patent Unexamined Publication No. 218005/1984, a member for cramping the outer periphery of the blank is formed by a flat plate, and it therefore tends to be drawn inwardly by the tension in the blank acting in opposite directions. If the blank is locally drawn inwardly, the accuracy of the formed surface is reduced.

In addition, it is necessary to effect after-work on the outer peripheral flange, etc., after the spherical shell surface has been formed. There is also a risk of increasing the profile irregularity by this after-work.

SUMMARY OF THE INVENTION

It is an object of the present invention to provide a method of manufacturing a metal article in the form of a spherical shell such as a parabolic antenna or a roof panel of a vehicle having a gentle curvature and having at its outer periphery a reinforcement portion. This method ensures that the article can be formed by the use of low-cost dies with a high degree of accuracy from a metal plate and even from a blank such as a punching metal sheet or a metal net.

To this end, the present invention provides a method which uses only one side die to form spherical surface and thereby reduces the overall cost of making dies, and which comprises the steps of: making the pressure of fluid act between an elastic diaphragm and on an air-escape recessed portion of the lower die so as to extend the elastic diaphragm; and bulging the blank into the form of a shell having a spherical surface, wherein a portion having the smallest curvature is brought into contact with the die at the final stage of the forming process.

DESCRIPTION OF THE PREFERRED EMBODIMENTS

An embodiment of the present invention will be described with reference to FIGS. 1 to 6.

Figure 1:
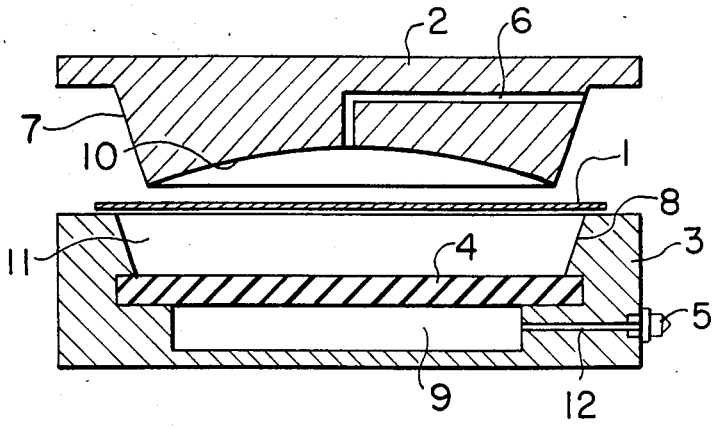
FIGS. 1 to 4 are cross-sectional views of a pressing process having an upper metal die and a lower die which represents an embodiment of the present invention, in which each step of the manufacturing process is shown.

FIG. 1 shows one embodiment of the present invention which employs an ordinary single action fluid pressure press to form, for example, a metal parabolic antenna, and shows, in cross section, the states of dies and a blank before the blank is worked to be given a tapered reinforcement flange portion for the purpose of reinforcing it at its outer periphery.

In FIG. 1, a reference numeral 1 denotes a metal plate which is provided as a blank and whose outer peripheral portion is to be formed into a tapered flange. An upper die 2 has at its outer periphery a cramp portion 7 for forming the outer flange portion of the blank 1, a concave surface 10 in the form of a spherical shell, and air-vent holes 6 formed in the vicinity of the central portion of this die or of the smallest curved portion of its spherical concave. On the other hand, a lower die 3 has a tapered and recessed clamp portion 8 for cramping the tapered flange portion of the blank 1, an elastic diaphragm 4 in the form of a plate made of, e.g., rubber stretched under this recessed clamp portion, an air-escape recessed portion 9, a fluid-pass hole 12 through which a fluid action opening 5 is communicated with the recessed portion 9.

As is understood from the drawing showing the embodiment, the blank 1 is interposed between under the upper die 2 and on the lower die 3.

Incidentally, a reference numeral 11 indicates an enclosed air space in the lower die 3.

Figure 2:
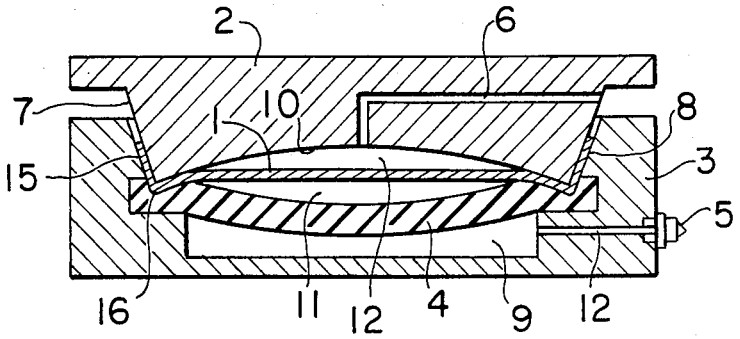

FIG. 2 shows, in sectional side view, the stage of the process in which an outer flange portion 15 is formed at the outer periphery of the blank 1 while being clamped between the upper die 2 and the lower die 3. This process is effected by moving the upper die 2 and the lower die 3 so as to press the blank 1 therebetween.

That is, in the process of forming the outer flange 15 of the blank 1, the enclosed air space 11 which is formed above the elastic diaphragm 4 disposed in the lower die 3 is compressed by the pressing force. The compressed air in the enclosed air space 11 acts to bulge the elastic diaphragm 4 toward the side of the air-escape recessed portion 9 of the lower die while slightly bulging the blank 1 toward the side of the upper die 2. According to this method, it is possible to limit the air pressure in the enclosed air space 11 to a lower level by the effect of clamping the flange portion of the blank 1 after the completion of formation thereof and by providing a large space for the air-escape recessed portion in the lower die. The effect of inwardly drawing the blank can be thereby prevented.

Figure 3:
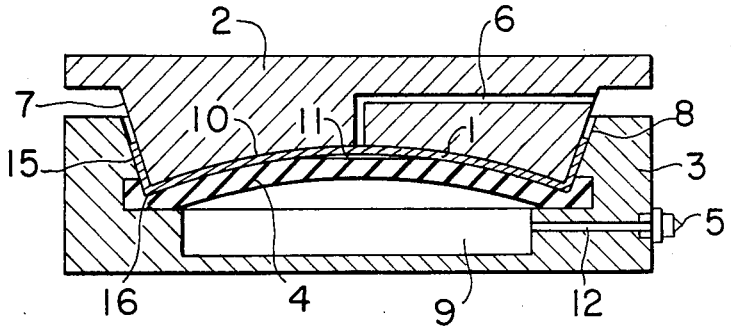

FIG. 3 shows, in sectional side view, the stage of the process which succeeds that shown in FIG. 2 and in which a fluid pressure is applied through the fluid action opening 5 to the air-escape recessed portion 9 of the lower die soas to push up the elastic diaphragm 4, thereby pressing the blank 1 against the spherical surface 10 of the upper die 2. That is, when the air in the enclosed air space 11 is compressed by the working pressure of the fluid, it acts as bulging force on the blank 1. Simultaneously, the working pressure of the fluid is maintained by enclosing the fluid at the outer periphery of the spherical portion where the outer peripheral portion of the elastic diaphragm 4 is clamped between the upper die 2 and the edge 16 of the blank 1.

The invention has been described with respect to the method whereby a solid metal plate is worked as a blank, but the invention is not limited to this. Punched metal sheets and metal plates in the form of net may be worked in accordance with the present invention. In those cases, the enclosed air space 11 is not formed and the spherical shell surface is formed while the elastic diaphragm 4 and the blank 1 are contacting each other over the entire area thereof.

Figure 4:
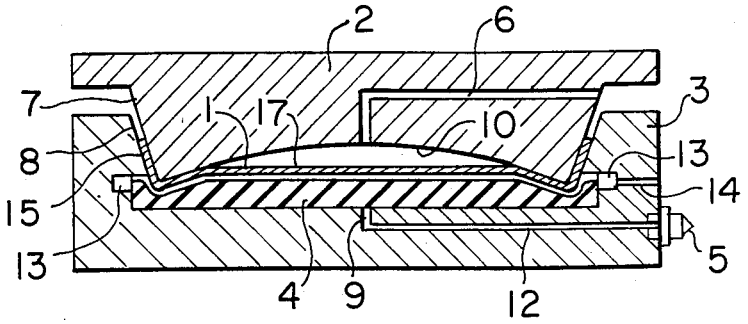

FIG. 4 shows an arrangement whereby a metal plate having no gas permeability which is provided as the blank 1 can be worked without forming the enclosed air space 11. Also the amount of working fluid in the actuated state is reduced by minimizing the internal space and, hence, the size of the air-escape recessed portion 9 of the female die.

In FIG. 4, constituents having the same reference numerals as those of the constituents in FIGS. 1 to 3 are similar or equivalent to the latter, and the relationship between the positions of the metal plate 1 and the upper and lower dies is shown.

As shown in FIG. 4, one or more small grooves 17 are disposed in the surface of the elastic diaphragm 4 which contacts the blank 1. These grooves are formed parallel, perpendicularly to each other, or radially to the outer periphery of the diaphragm. An annular air-vent channel 13 is formed in a position corresponding to the small grooves 17 of the elastic diaphragm 4, and an air holes 14 is formed to provide a communication between this channel 13 and the external air. In the lower die thus arranged, the enclosed air space between the blank 1 and the elastic diaphragm 4 is eliminated, thereby preventing the blank 1 from being drawn inwardly by the air pressure in the enclosed air space 11. As the enclosed air space 11 is eliminated, it is possible to reduce the size of the air-escape recessed portion so as to reduce the amount of working fluid employed.

In addition, the small grooves 17 function as inlets for air which act to facilitates the detachment of the blank 1 from the elastic diaphragm.

Figure 5:
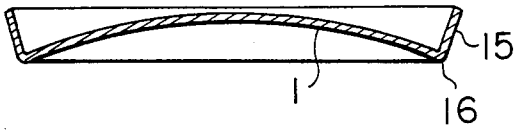
FIG. 5 is a cross-sectional side view of a blank which has been worked into the prescribed form of a spherical shell.

FIG. 5 is a cross-sectional view of an example of a parabolic antenna which is formed by the method in accordance with the present invention. The blank 1 is worked in the above-described manner to have a spherical surface and have at its outer periphery a reinforcement flange portion, thus forming the surface of the parabolic antenna.

Figure 6:
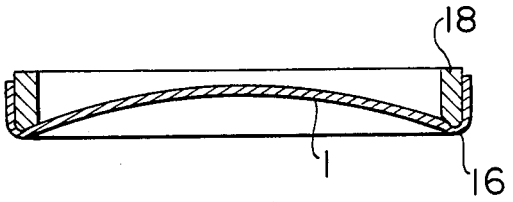
FIG. 6 is a cross-sectional side view of a worked blank in the form of a spherical shell to which a reinforcement member has been previously attached on the flange portion of its outer periphery.

FIG. 6 is a cross-sectional view of another example of the parabolic antenna formed by the method in accordance with the present invention. The blank 1 to which a reinforcement member 18 has been previously attached is clamped by the upper die 2 and the lower die 3, and the dies are sealed at the outer peripheral portion of the elastic diaphragm 4 by the effect of the edge 16, thus forming a spherical surface of the parabolic antenna.

In one embodiment of the present invention, the flange portion of the metal article in the form of a spherical shell is formed while being clamped between the tapered clamp portion formed at the outer periphery of the male die and the tapered and recessed clamp portion formed along the outer peripheral portion of the lower die, thus forming the tapered reinforcing flange portion. Therefore, it is possible to securely clamp the blank. The fluid pressure is thereafter applied to the blank, and the blank can be worked without being drawn inwardly from the outer peripheral portion of the dies. It is thereby possible to prevent creases from being formed on the blank. Since, in accordance with this method, the material is drawn in the direction of the spherical surface which is to be formed, it is possible to minimize the degree of spring back and, hence, to reduce the profile irregularity of the spherical surface. In addition, the roughness on the spherical surface due to a defective state of the surface of the die can be eliminated. It has not been possible for any method to eliminate the roughness on the spherical surface due to a defective state of the surface of the die, as far as the inventor knows before. The surface formed in accordance with the present invention is free from such roughness so that it is possible to omit the polishing work on the inside of concaved surface.

Even when the thickness of the blank is changed, a spherical shell having a tapered reinforcement flange portion can be formed by adjusting the pressure of fluid. In this case also, it is possible to realize a high degree of accuracy of the spherical surface.

Since the elastic diaphragm is employed in the arrangement in accordance with the present invention, it is possible to maintain the pressure of fluid even in the process of forming punching metal sheets or metal plates in the form of net or mesh, thereby ensuring the same degree of accuracy as that in the case of ordinary solid metal plates.

The invention has been described with respect to the case of employing a rubber plate as the elastic diaphragm, but, in accordance with the present invention, this member is not limited to this type. A flat metal sheet can also be applied as the elastic diaphragm.

Figure 8:
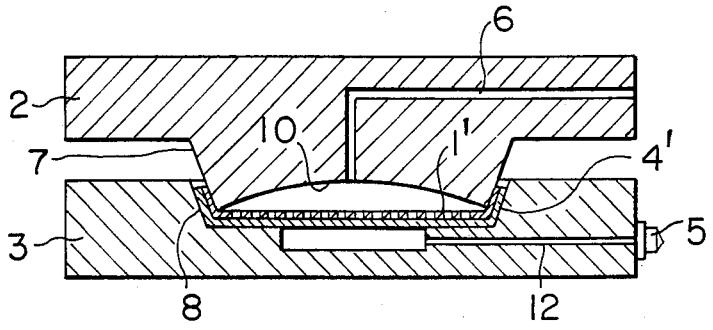
Figure 9:
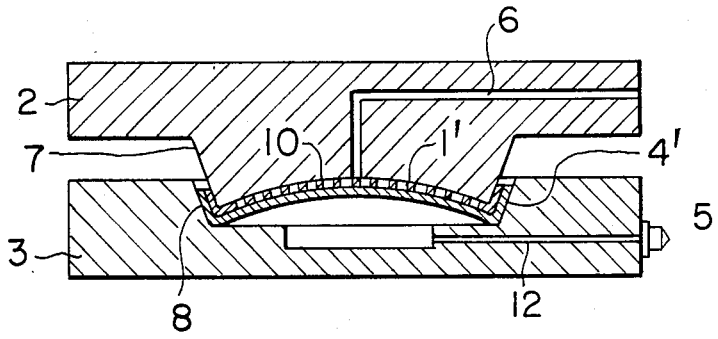

Another embodiment employing such a metal diaphragm will be described with reference to FIGS. 7 to 9 in which constituents having the same reference numerals as those of the constituents shown in FIGS. 1 to 3 are similar or equivalent to the latter, and in which the above-described metal sheet in the form of net is applied as a blank.

Figure 7:
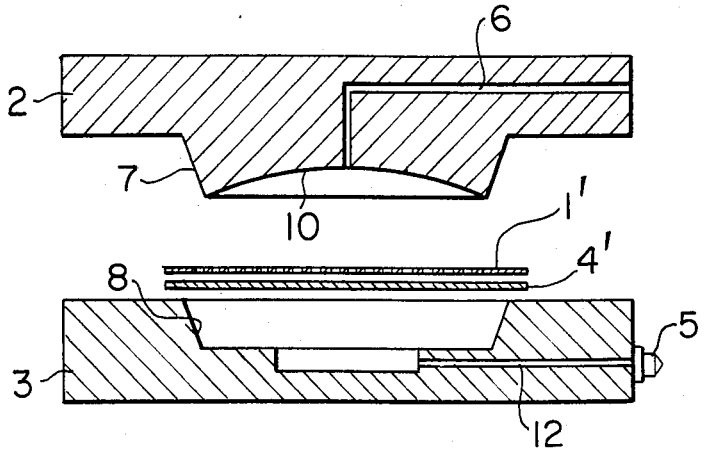
FIGS. 7 to 9 are cross-sectional views of a pressing process having an upper die and lower die which represents another embodiment of the present invention, in which each step of the manufacturing process is shown.

As shown in FIG. 7, a blank plate 1' having air holes in the form of net or mesh is superposed on a flat metal plate 4' made of, e.g., steel sheet, and those plates are placed in a predetermined position on the lower die 3. In this state, the fluid communication opening 5 is open. The upper die 2 and the lower die 3 disposed on the press are moved such that the upper die 2 is moved down by the operation of the press and outer flange reinforcement portions of the blank plate 1' and the flat metal sheet 4' are formed, as shown in FIG. 8, between the tapered clamp portion 7, which is formed at the outer periphery of the spherical surface portion 10 formed in the upper die 2, and the tapered and recessed clamp portion 8 formed in the lower die 3, thereby clamping the two plates while maintaining the pressing force of the press. Meanwhile, the air between the lower die 3 and the flat metal sheet 4' is released to the atmospheric air by way of the fluid action hole 12 and through the fluid communication opening 5, thereby preventing the blank plate 1' and the flat metal plate 4' from bulging in the die.

The press continues to apply the pressure while preventing the slippage of the blank at the clamp portions. Simultaneously, the pressurized fluid is supplied through the fluid communication opening 5, thereby bulging the flat metal sheet 4'. The metal sheet 4' thereby deformed acts to bulge the blank plate 1' at the same time, and the blank plate 1' is pressed against the spherical surface 10 of the male die 2. The air between the blank plate 1' and the spherical surface 10 is released to the atmospheric air through the air vent holes 6, and the flat metal sheet 4' together with the blank plate 1' are formed to be spherical shells by the working pressure of the fluid, thus completing the work. The metal sheet 4' and the blank plate 1' removed from the die are detached from each other by hand, thus manufacturing, for example, a parabolic antenna in the form of a dish having air holes.

The tapered cramp portion 7 formed in the upper die 2 and the tapered and recessed cramp portion 8 formed in the lower die 3 are made to be parallel to each other in order to form the blank plate 1' together with the flat metal sheet 4', to cramp the same and to enclose the fluid at the same time. A combination of a groove and a protrusion may be provided instead of tapers so as to form the outer periphery reinforcement portion, thereby clamping the blank and enclosing the fluid. Also a combination of a tapered portion and a cylindrical portion may be effective for preventing wavelike deformations at the outer flange reinforcement portion of the blank.

Since this manufacturing method employs a flat metal sheet instead of an elastic diaphragm, even when a metal plate in the form of mesh is worked as a blank, it is possible to prevent the elastic diaphragm from wearing at the cut edges of the holes forming the mesh portion.

An example of a blank manufactured in the above-described manner will be described with reference to FIGS. 10 to 13.

Figure 10:
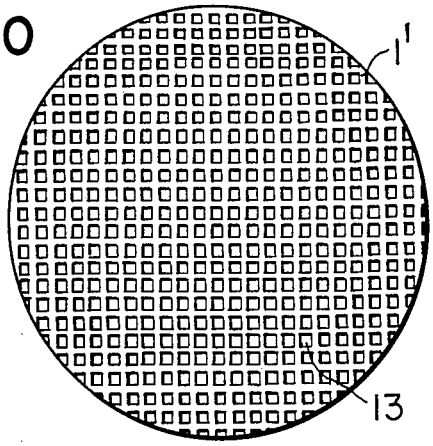
FIG. 10 is a plane view of an example of a blank to be worked.
Figure 11:
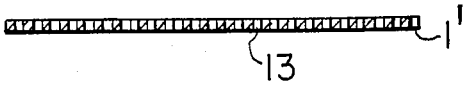
FIG. 11 is a cross-sectional view of this blank.

FIG. 10 is a plane view of a blank 1' in the form of a metal plate which has been previously formed by punching to have a multiplicity of air holes 13 disposed in the whole portion of a micro-wave reflecting surface. FIG. 11 is a cross-sectional view of this plate taken along the center line of the air hole 13.

Figure 12:
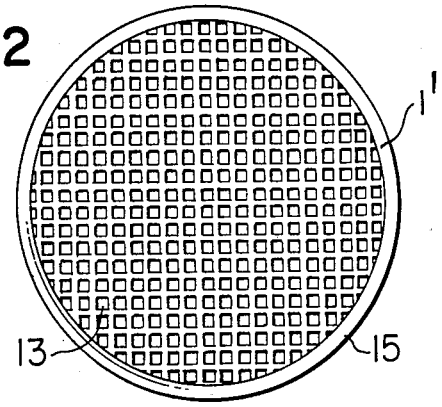
FIG. 12 is a plane view of the blank after it is worked into the prescribed form of a spherical shell.
Figure 13:
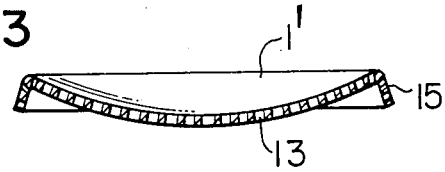
FIG. 13 is a cross-sectional view of the shell formed from the blank.

FIG. 12 is a plan view of the blank after the formation of a parabolic antenna in the form of a dish, and FIG. 13 is a cross-sectional view of this dish taken along air holes 13 in the vicinity of the center of the dish.

In FIGS. 12 and 13, a reference numeral 15 denotes a flange portion of the blank 1' after the same is worked in the dishing manner. This flange portion is provided as a reinforcement portion for mounting.

According to the present invention, as described above, the portion having the smallest curvature is brought into contact with the die in the final step of the forming process so that the blank is formed by constant and uniform tensile force in the circumferential direction and it is possible to prevent the blank from being locally drawn inwardly by the clamping force in flange portion of the blank. Therefore, a high degree of uniformity of the extension of a material can be realized, and it is possible to prevent the generation of deformations or creases at the outer peripheral portion of the blank and to eliminate the roughness of the spherical shell surface due to a defective state of the die surface.

What is claimed is:

1. A method of forming a flat blank into a spherical shell, comprising steps of:

forming an upper die and a lower die to mate with each other, said upper die having an annular tapered mating surface at a peripheral portion thereof and a concave surface corresponding to the shape of said spherical shell at a central portion thereof, and said lower die having a mating surface corresponding to that of said upper die and being provided with an elastic diaphragm at the central portion thereof adjacent to the bottom edge of said tapered surface of the lower die;

disposing said flat blank between two dies, and pressing the dies with a force sufficient to perform the following step: deforming the peripheral portion of the flat blank into an annular tapered shape, clamping the deformed peripheral portion of the flat blank, and preventing the tapered portion from slipping inwardly during formation of a spherical shell; and applying fluid pressure on one side of said diaphragm towards said concave surface of the upper die, to bulge the elastic diaphragm and, at the same time, form said blank into a shape corresponding to said concave surface of said upper die.

2. A method of manufacturing a meshed blank of spherical shell shape, comprising steps of:

preparing a flat meshed blank by making a plurality of holes in the blank except for a peripheral portion of the blank which remains solid, and a flat solid metal sheet corresponding in size to the blank;

forming an upper die and a lower die to mate with each other, said upper die having an annular tapered mating surface at a peripheral portion thereof and a concave surface corresponding to the shape of said spherical shell at a central portion thereof, and said lower die having a mating surface corresponding to that of said upper die;

superposing said flat meshed blank and said flat solide metal sheet;

disposing said superposed blank and sheet between said upper and lower dies with the blank positioned nearer than is the sheet to the upper die;

pressing said dies with a force sufficient to perform the following step: deforming the peripheral portions of the blank and sheet into annular tapered shapes, clamping the thus deformed peripheral portions, and preventing the tapered portions of the blank and sheet from slipping inwardly during formation of a spherical shell; and applying fluid pressure on the underside of said metal sheet to bulge the metal sheet and to form said meshed blank into a shape corresponding to said concave surface of said upper die.

* * * * *